US005832744A

United States Patent [19]

Dorste et al.

[11] Patent Number: 5,832,744

[45] **Date of Patent: *Nov. 10, 1998**

[54] DISTRIBUTOR FOR REFRIGERATION SYSTEM

[75] Inventors: David C. Dorste, Washington; Robert S. Ens, St. Louis; Joseph H. Heffner, Chesterfield, all of Mo.

[73] Assignee: Sporlan Valve Company, Washington, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 714,694

[22] Filed: Sep. 16, 1996

[51] Int. Cl.[6] ..... F25B 41/04

[52] U.S. Cl. ..... 62/528; 137/540; 137/565.1

[58] Field of Search ..... 62/525, 527, 528; 137/540, 565.1

[56] References Cited

U.S. PATENT DOCUMENTS

| | | | |
|---|---|---|---|
| 1,443,675 | 1/1923 | Bowler | 137/540 |
| 1,985,617 | 12/1934 | Morton | 62/127 |
| 2,147,678 | 2/1939 | Smith | 62/129 |
| 2,148,412 | 2/1939 | Conrad | 62/8 |
| 2,148,413 | 2/1939 | Labberton et al. | 62/8 |
| 2,148,414 | 2/1939 | Wolfert et al. | 62/127 |
| 2,461,876 | 2/1949 | Boyle | 62/525 |
| 3,563,055 | 2/1971 | Owens | 62/525 |
| 4,549,567 | 10/1985 | Horton | 137/262 |
| 5,333,640 | 8/1994 | Swift et al. | 137/262 |
| 5,479,784 | 1/1996 | Dobmeier et al. | 62/117 |

OTHER PUBLICATIONS

Sporlan Valve Company, Refrigerant Distributors – Bulletin 20—10 – Jun. 1975, USA.

*Primary Examiner*—William E. Tapolcai
*Attorney, Agent, or Firm*—Cohn, Powell & Hind

[57] ABSTRACT

This refrigerant distributor (20) is used in a refrigeration system (10) for delivering refrigerant from a thermostatic expansion valve (18) to a multi-circuit evaporator (22). The distributor (20) includes a body (30) having an inlet (32) providing a nozzle (40), an outlet (34) providing a plurality of discharge passages (52) and a head space (48) disposed between the nozzle (40) and the discharge passages (52). A member (56) is movable in the head space (48) to vary the flow from the nozzle passage (40) into the discharge passages (52) to suit normal load and pulldown load.

16 Claims, 5 Drawing Sheets

DISTRIBUTOR FOR REFRIGERATION SYSTEM

BACKGROUND OF THE INVENTION

This invention relates generally to refrigeration systems having a compressor, a condenser, an evaporator, an expansion valve and a distributor, and more particularly to a distributor for improving the even mixing and equal distribution of refrigerant supplied from the expansion valve to a multi-circuit evaporator.

A distributor in a refrigeration system is a device used for dividing the flow of refrigerant from the outlet of the thermostatic expansion valve to the various circuits of a multi-circuited evaporator coil.

An early distributor was patented by Westinghouse Electric Manufacturing Company in 1939 and is disclosed in U.S. Pat. No. 2,148,414. Later developments are disclosed in the Sporlan Valve Company Bulletin 20-10. These two references show that several factors have been considered in the prior art in creating an effective system of equal distribution from the thermostatic expansion device to a multi-circuit evaporator. The primary factors may be summarized as follows: (i) providing a pressure drop to create turbulence and promote mixing; (ii) providing equal dispersion and flow; and (iii) providing for delivering refrigerant at a sufficiently high velocity to prevent the mixture of gas and liquid from stratifying.

With respect to pressure drop, an initial pressure drop is achieved in the expansion valve of a refrigeration system, which receives liquid at high pressure and temperature at its inlet and flashes it to a mixture of liquid and gas for delivery from its outlet. As refrigerant enters the distributor, the mixture of liquid and gas is not homogenous and it experiences a further pressure drop and mixing in the distributor. In U.S. Pat. No. 2,148,414 a second pressure drop is effectuated by the inlet nozzle of the distributor, and mixing is effectuated by the provision of fine mesh screens, which divide the liquid and gas into smaller particles to form a more uniform mixture. This mixture is supplied to smaller, circumferentially arranged tubes provided in the outlet of the distributor in which the refrigerant mixture is subjected to a third pressure drop.

With respect to dispersion and flow, the Sporlan Bulletin 20-10 discloses improvements including the use of an interchangeable nozzle and a conical pin, which is intended to deflect the mixture evenly into the circumferentially spaced outlet passageways.

Problems remain in reconciling flow velocity during both normal load and pulldown load conditions. Over the years, information resulting from experiment and experience has provided useful data for determining the recommended pressure drop for the two restrictions provided by prior distributors, namely, that resulting from the selection of the distributor inlet nozzle size and that resulting from the reduction in the size of the distributor passages and tubes. This data is useful in sizing distributors when the refrigeration system normal load remains within a reasonable, fairly constant, range. However, as the flow decreases, the pressure drop at the distributor nozzle and outlet passages and tubes is reduced and distribution suffers. On the other hand, if the nozzle is reduced and sized for relatively low flow, normal holding load conditions then, when high load conditions are experienced, flow is restricted and the system cannot keep up with demand. Typically, high load conditions occur at pulldown, and the pulldown load may be two to three times the normal holding load. However, sizing the distributor to suit high load conditions results in inefficient operation under normal load conditions.

This invention solves these and other problems in a manner not disclosed in the known prior art.

SUMMARY OF THE INVENTION

This invention provides a distributor for use in a refrigerant system which improves the dispersion and flow of refrigerant between a thermostatic expansion valve and a multi-circuit evaporator during variable load conditions.

The distributor is structured to provide the effect of a variable nozzle selectively restricting refrigerant flow and can be used to accommodate a holding load and a pulldown load without actually changing the nozzle passage size. The variable nozzle effect may be achieved by using a spring-loaded flat-ended piston in conjunction with a nozzle passage sized for pulldown load. Alternatively, the variable nozzle effect may be achieved by using a spring-loaded, conical ended piston in conjunction with a nozzle passage sized for pulldown load. In each case the spring-loaded piston maintains a substantially constant pressure drop regardless of flow through the nozzle by varying the spacing of the piston from the nozzle passage, and therefore the area of the flow annulus. Consequently, the pressure drop can be adjusted by varying the spring loading. As further enhancements, particularly in the case of a conical piston, a spinning turbine may be mounted to the piston shaft to disperse the refrigerant equally.

This distributor for delivering refrigerant from an expansion valve to a multi-circuit evaporator comprises a body including inlet means, outlet means and a chamber communicating between the inlet means and the outlet means; the inlet means including a nozzle passage; the outlet means including a plurality of discharge passages, and flow control means within the chamber, effective to vary the flow from the nozzle passage into the discharge passages to suit normal load and pulldown load.

It is an aspect of this invention to provide that the flow control means includes a piston mounted in the body and having an end, and means urging the end toward the nozzle passage.

It is another aspect of this invention to provide that the piston includes a portion in the chamber reducing the chamber volume and increasing the refrigerant velocity and thereby improving refrigerant distribution.

It is still another aspect of this invention to provide that the piston end includes a substantially flat portion and the piston is disposed in variable axial relation to the nozzle passage and another aspect to provide that the nozzle passage includes an inlet opening an outlet opening; and the piston flat end portion is of a size greater than the outlet opening.

It is an aspect of this invention to provide that the piston end includes a substantially conical end received by the nozzle passage to define a variable annulus.

It is another aspect of this invention to provide that the chamber includes a first frusto-conical portion communicating with the nozzle passage and a second frusto-conical portion communicating with the discharge passages.

It is still another aspect of this invention that the conical end of the piston includes a first portion received by the nozzle passage and a second portion adjacent the first portion, the second portion having an angle of taper larger than that of the first portion.

It is yet another aspect of the invention that the piston first end portion projects outwardly beyond the nozzle passage inlet opening to assist in dispersing the refrigerant entering the chamber, and an another aspect to provide that the piston first end portion has an angle of taper smaller than that of the piston second end portion.

It is another aspect of this invention to provide that the piston includes a rotatable member mounted to a piston shaft and tending to produce turbulence within the chamber during refrigerant flow and another aspect to provide that the rotatable member includes vane means causing the rotatable member to rotate in response to pressure exerted on said vane means by said refrigerant and distribute the refrigerant evenly to the discharge passages, and still another aspect to provide that the piston includes a collar slidably mounted to the body and providing a retainer for the rotatable member.

It is an aspect of the invention to provide that the flow control means includes a passage mounting the piston in sliding relation to the body and housing a resilient means exerting a pressure tending to move said piston toward said nozzle and still another aspect to provide that the piston is hollow to provide a housing for a spring providing the resilient means.

It is another aspect of this invention to provide that the nozzle is removable and replaceable with a nozzle having a passage of different size.

This improved distributor is relatively inexpensive and easy to manufacture and effectuates superior dispersion and mixing of refrigerant under different flow conditions.

DESCRIPTION OF THE PREFERRED EMBODIMENT

Figure 1:
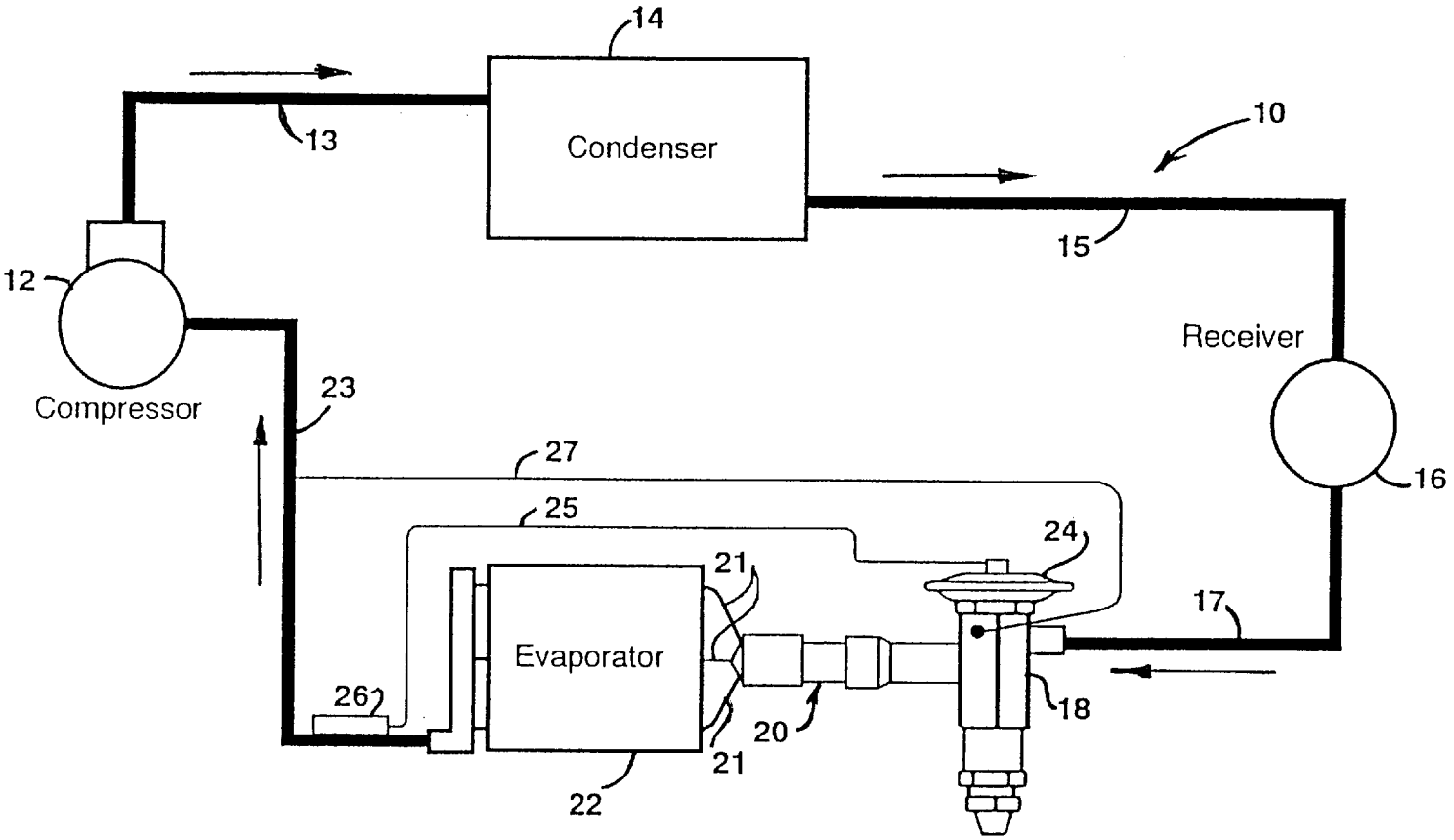
FIG. 1 is a diagrammatic view of the refrigeration system in which the distributor is used.
Figure 2:
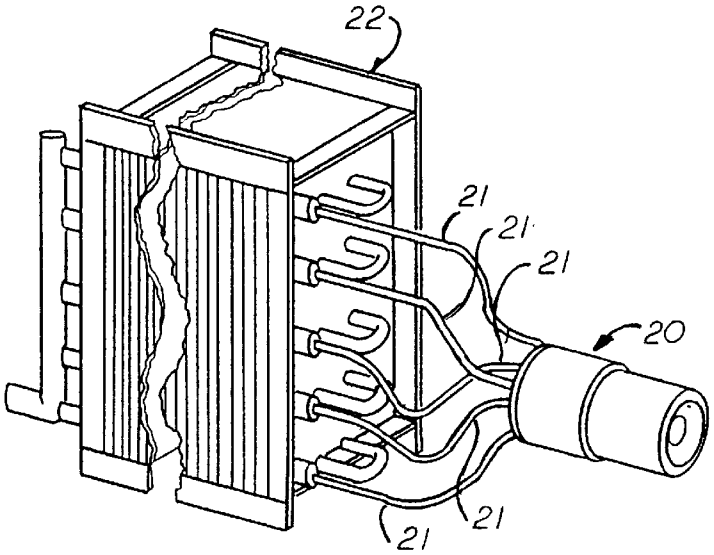
FIG. 2 is a perspective view of a multi-circuit evaporator with the distributor attached.
Figure 3:
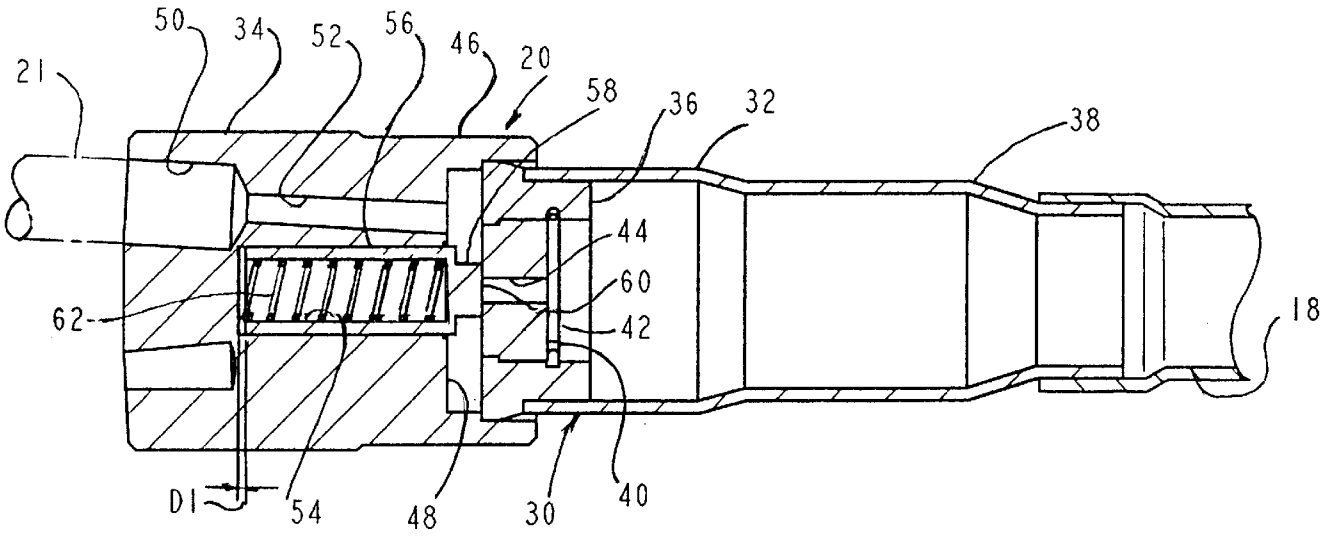
FIG. 3 is longitudinal cross-sectional view of one embodiment of an assembled distributor.
Figure 4:
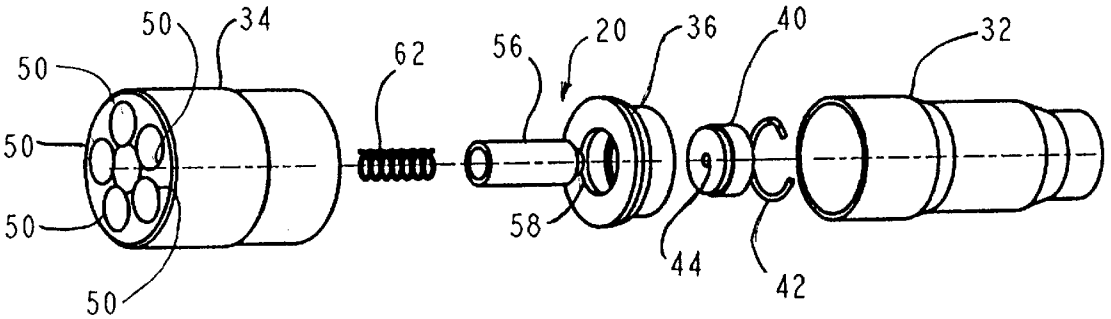
FIG. 4 is an exploded perspective view of the distributor of FIG. 3.
Figure 6:
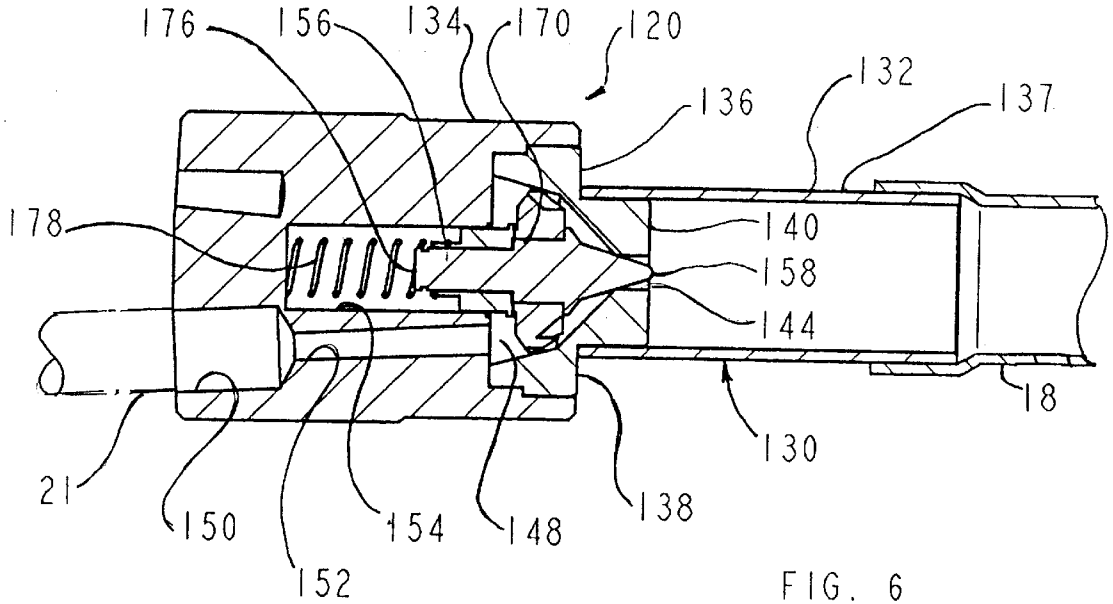
FIG. 6 is longitudinal cross-sectional view of another embodiment of an assembled distributor.
Figure 7:
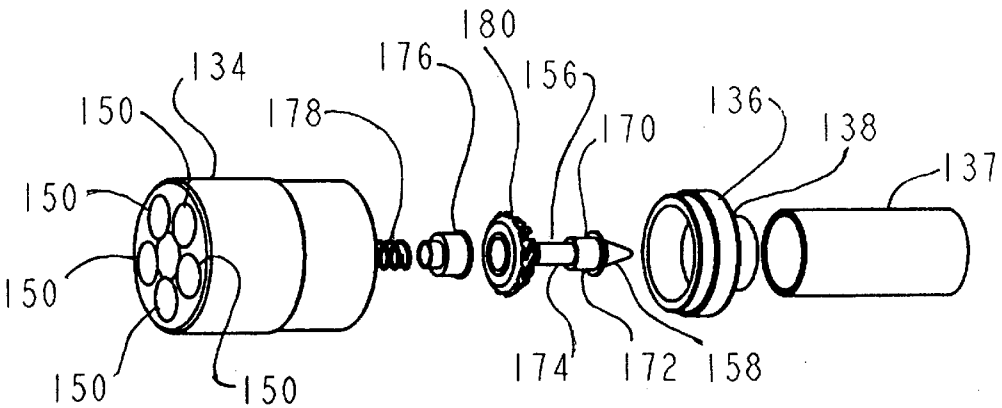
FIG. 7 is a perspective view of the distributor of FIG. 6.
Figure 9:
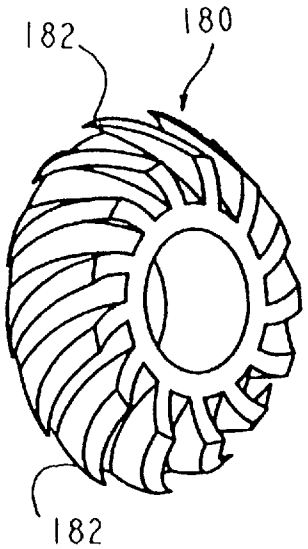
FIG. 9 is an enlarged perspective view of the turbine member of the embodiment of FIG. 6.

Referring now by reference numerals to the drawings and first to FIGS. 1 and 2, it will be understood that the refrigeration system 10, in which the distributor is used, includes a compressor 12, connected to a condenser 14 by line 13; a receiver 16 connected to the condenser 14 by line 15, and an expansion valve 18 connected to the receiver 16 by a line 17, and a multi-circuit evaporator 22 connected to the expansion valve 18 through a distributor 20. The distributor 20 is connected to the outlet of the expansion valve 18 and to the inlets of evaporator 22 by lines 21 and the evaporator 22 is connected to the compressor 12 by suction line 23. As is typical, the diaphragm 24 of the expansion valve 18 is provided with a capillary tube 25 having a bulb 26 in contact with the line 23 downstream of the evaporator outlet and communicating with the upper side of the diaphragm 24. Also, in the embodiment shown, an external tube 27 connects the expansion valve 18 to the suction line 23, downstream of the bulb 26, the line 23, thereby communicating with and subjecting the underside of the diaphragm 24 to the suction line pressure. A preferred embodiment of the distributor 20 will now be described by reference to FIGS. 3–5.

The distributor 20 includes a body 30 having an inlet portion 32 attached to an outlet portion 34. The inlet portion 32 includes an annular portion 36 and a tubular portion 38 having one end which overfits a reduced diameter of the annular portion 36 and engages a stop shoulder provided on the exterior face of said nozzle 36. The other end of the tubular portion 38 is connected to the expansion valve 18. The annular portion 36 provides a housing for a nozzle 40, which is held between an annular shoulder provided on the interior face of the annular portion 36 and a retaining ring 42 received by the grooved interior face of said annular portion. The nozzle 40 includes a passage 44, which is of a diameter to suit a particular refrigeration system, and the nozzle can readily be removed and replaced by another nozzle having a passage of a different diameter to suit a different refrigeration system. The body 34 outlet portion includes a socketed end 46 having an interior shoulder providing a stop engageable by the annular portion 36 and defining a head space 48 providing a chamber communicating with the nozzle passage 44. At its other end, the body 34 outlet portion includes a plurality of circumferentially spaced sockets 50, five in number in the embodiment shown, sized to receive the lines 21 connecting the distributor 20 to the multi-circuit evaporator 22. The outlet portion 34 further includes discharge passages 52 communicating between the lines 21 and the head space 48. The outlet portion 34 also includes a blind passage 54 coaxial with the nozzle passage 44 and also communicating with the head space 48.

Figure 5:
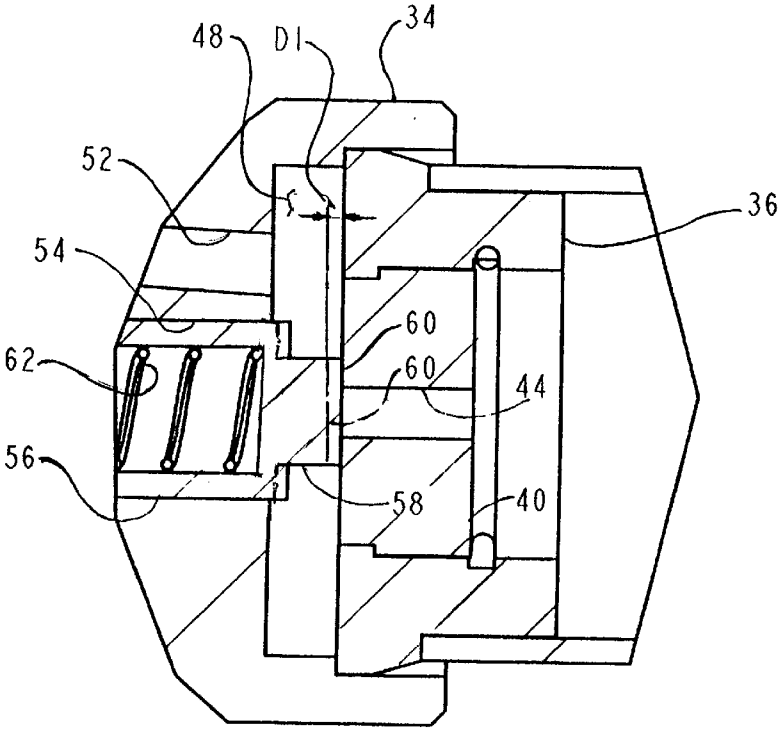
FIG. 5 is an enlarged, partly schematic, detail of the distributor of FIG. 3.

The passage 54 receives a hollow piston 56 in sliding relation, said piston constituting a flow control means. In the embodiment shown, the piston 56 includes a reduced diameter end 58 defining a flat circular face 60 disposed adjacent the nozzle passage 44, as best shown in FIG. 5. The hollow piston 56 includes a compression spring 62 tending to urge the flat face 60 into engagement with the nozzle 36, thereby tending to close the passage 44 and reduce the effective area of the flow annulus.

The structural arrangement of parts in the embodiment described above, effectively provides a variable nozzle which maintains the pressure drop across the nozzle to a substantially constant amount regardless of refrigerant flow from the expansion valve 18. The nozzle passage 44 is sized for pulldown load, that is, with the piston 56 at maximum stroke engaging the bottom of the blind passage 54, there is maximum flow between the nozzle passage 44, the head space 48 and the discharge passages 52 connected to the lines 21. In this position, as shown in phantom outline in FIG. 5, the piston is moved axially away from the nozzle 40 under pulldown load until the flat end face 60 is spaced a sufficient distance, indicated by D1, from the nozzle passage 44 that it does not provide significant restriction to affect the flow of refrigerant and provides substantially free flow at pulldown load.

At normal, or holding, load the piston spring 62 urges the piston 56 toward the nozzle passage 44 tending to maintain a substantially constant pressure of, for example, 60 p.s.i. regardless of the substantially unrestricted flow capacity through the nozzle passage 44 at pulldown load. The pressure drop can be adjusted by varying the spring load, but a 60 p.s.i. differential has been found to provide optimum performance for most practical purposes. The provision of a reduced head space and the reduction in size of the discharge passages 52 has also been found to provide beneficial pressure drop which aids refrigerant mixing. It will be understood that the portion of the piston 56 in the head space 48 reduces the clear volume of the head space, thereby increasing the refrigerant velocity and improving distribution.

A second preferred embodiment of the distributor, indicated by numeral 120, is shown by reference to FIGS. 6–9. As shown, the distributor 120 includes a body 130 having an inlet portion 132 attached to an outlet portion 134. The inlet portion 132 includes an annular portion 136 and a tubular portion 137. The tubular portion 137 has one end which overfits a reduced diameter part of annular portion 136 and engages a stop shoulder provided on the exterior face of said annular portion. The other end of the tubular portion 137 is connected to the expansion valve 18. The annular portion 136 includes an inner portion 138 received by the outlet portion 134 and a reduced diameter nozzle portion 140, which includes a passage 144. In the embodiment shown, the annular portion 136 defines a head space 148 providing a chamber, which includes a first frusto-conical portion 147 communicating with the nozzle passage 144 and a second frusto-conical portion 149. At its other end, the body 134 includes a plurality of circumferentially spaced sockets 150 sized to receive lines 21 connecting the distributor 120 to the multi-circuit evaporator 22. The outlet portion 134 includes discharge passages 152 communicating between the lines 21 and the second portion 149 of the head space 148. The outlet portion 134 also includes a blind passage 154 coaxial with the nozzle passage 144 and also communicating with the clear head space 148.

Figure 8:
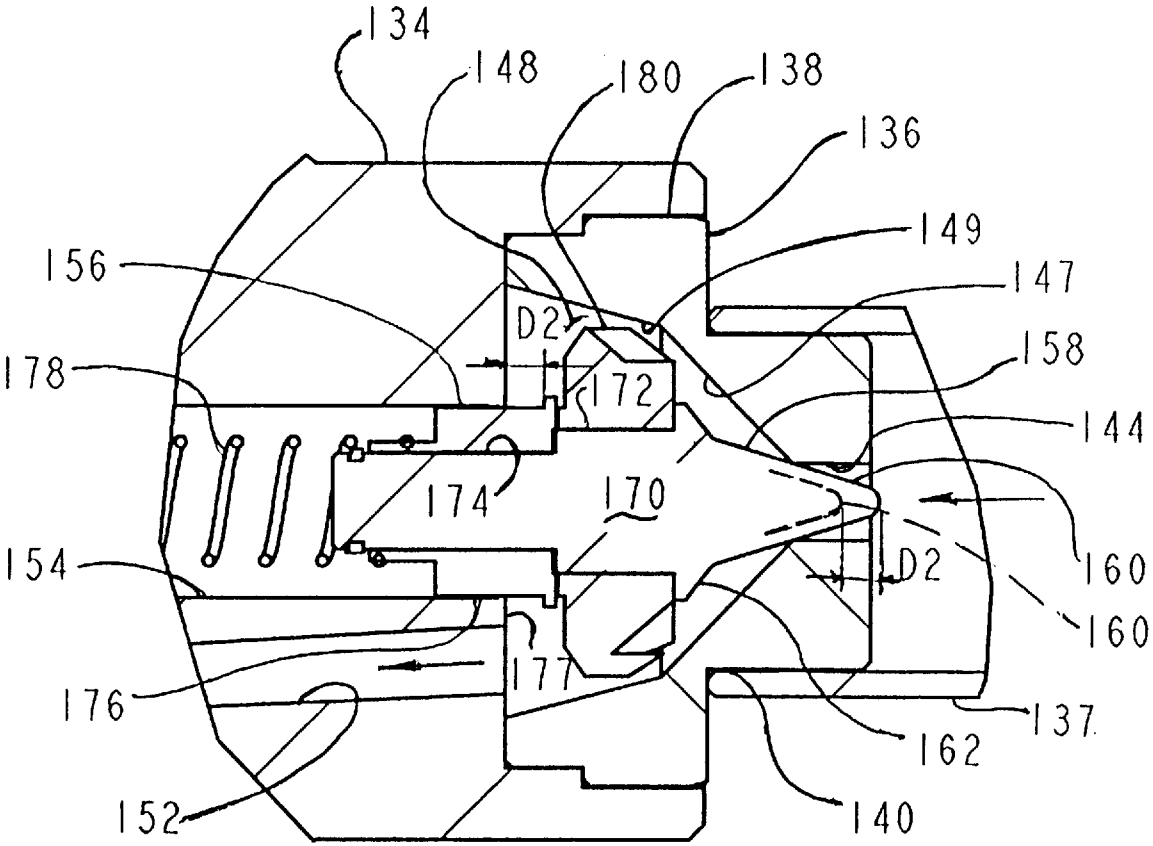
FIG. 8 is an enlarged, partly schematic, detail of the distributor of FIG. 6.

The passage 154 receives a piston 156 in sliding relation, said piston constituting a flow control means. In the embodiment shown, the piston 156 includes a double conical end or head 158 having a first and second portions 160 and 162. The first portion 160 has an angle of taper which is preferably an acute angle, and the second, shorter portion 162 has an angle of taper which is preferably an obtuse angle. As shown in FIG. 8, the first end portion 160 may project outwardly of the inlet of the nozzle passage 144. The second end portion 162 is shorter than the first end portion 160 and has an angle somewhat larger than the angle of the second conical portion 147. This arrangement provides that the first end portion 160 engages the nozzle passage 144 before engagement of the second end portion 162 with the first head space portion 147.

The piston 156, in the embodiment shown, includes a shaft 170, which is reduced in diameter to provide a first shaft portion 172 and a second shaft portion 174. The second shaft portion 174, in the embodiment shown, is grooved at one end to accept a snap ring to retain a collar 176. The collar 176, which is slidably received within the passage 154, engages the shoulder between the first and second shaft portions 172 and 174. A spring 178 is also received within the passage 154 and is mounted upon a reduced end portion of the collar 176 to engage the collar 176 and urge the collar, and therefore the piston 156, into a closed position with the nozzle passage 144.

In the embodiment shown, a turbine member 180, having spiral vanes 182, is mounted to the first shaft portion 172 in rotatable relation so that refrigerant pressure on the vanes 182 causes the turbine member to spin and distribute refrigerant evenly into the passages 152. In the embodiment shown, the turbine member 180 is retained between the piston second end portion 162 and the collar 176.

The structural arrangement of parts provided in the second embodiment provides a further flow enhancement by the use of the swirling or spinning turbine member 180 combined with the piston 156 having a conical end 158. The turbine member 180 is freely rotatably mounted on the piston shaft portion 172 in spinning relation and is driven by the velocity of the refrigerant through the nozzle passage 144. The swirling motion of the turbine member 180 results in a very homogeneous mix. However, to be effective the concept is only viable if the pressure drop across the nozzle is substantially constant to provide a refrigerant force sufficient to drive the turbine member. The piston 156, on which the turbine member is mounted, is spring-loaded to provide the variable nozzle concept discussed above with respect to the first embodiment.

A distinction between the pistons 56 and 156 of the first and second embodiments is that the regulating end of the piston 156 is conical in shape. This conical configuration acts to disperse the refrigerant evenly onto the turbine member. The maximum annulus area formed between the nozzle passage 144 and the conical portion 160, occurs at the maximum stroke of the piston member 156, that is, when the collar 176 engages the abutment face 177. The maximum annulus area is sized to equal the nozzle passage size for pulldown load. In this position, as shown in phantom outline in FIG. 8, the piston conical end is spaced a sufficient distance from the closed position, indicated by D2, that the annulus area does not provide significant restriction to affect the flow of refrigerant and provides substantially free flow at pulldown load. As with the first embodiment, the portion of the piston 156 in the head space reduces the clear volume of the head space thereby increasing the refrigerant velocity and improving distribution. It will be understood that when the piston conical portion 160 is fully engaged within the nozzle passage 144 to effectively close said passage, there is sufficient clearance between the periphery of the turbine 180 to provide for free rotation of said turbine.

It has been found that machining the piston conical nose portion 160 so that the point of the cone protrudes beyond the nozzle passage portion 143 assists in dispersing the refrigerant at the outlet of the expansion valve 18. As with the first embodiment, an additional pressure drop is provided by reducing the clear head space 148 and reducing the size of the discharge passages 152.

Although the invention has been described by making detailed reference to preferred embodiments, such detail is to be understood in an instructive rather than in any restrictive sense, many other variants being possible within the scope of the claims hereunto appended.

We claim as our invention:

1. A distributor for delivering refrigerant from an expansion valve to a multicircuit evaporator, the distributor comprising:

(a) a body including inlet means, outlet means and a chamber communicating between the inlet means and the outlet means;

(b) the inlet means including a nozzle passage sized large enough for pulldown load;

(c) the outlet means including a plurality of discharge passages, and (d) movable flow control means within the chamber providing a variable restriction to continuous refrigerant flow by reducing the effective nozzle passage, sized for pulldown load, to an effective nozzle passage sized for holding load.

2. A distributor as defined in claim 1, in which:

(e) the flow control means includes a piston mounted in the body and having an end, and means urging the end toward the nozzle passage.

3. A distributor as defined in claim 2, in which:

(f) the piston includes a portion in the chamber reducing the chamber volume and increasing the refrigerant velocity and thereby improving refrigerant distribution.

4. A distributor as defined in claim 2, in which:

(f) the piston end includes a substantially flat portion and the piston is disposed in variable axial relation to the nozzle passage.

5. A distributor as defined in claim 4, in which:

(g) the nozzle passage includes an inlet opening an outlet opening; and (h) the piston flat end portion is of a size greater than the outlet opening.

6. A distributor as defined in claim 2, in which:

(f) the piston end includes a substantially conical end received by a nozzle passage to define a variable annulus.

7. A distributor as defined in claim 6, in which:

(g) the chamber includes a first frusto-conical portion communicating with the nozzle passage and a second frusto-conical portion communicating with the discharge passages.

8. A distributor as defined in claim 6, in which:

(g) the conical end of the piston includes a first portion received by the nozzle passage and a second portion adjacent the first portion, the second portion having an angle of taper larger than that of the first portion.

9. A distributor as defined in claim 8, in which:

(h) the piston first end portion projects outwardly beyond the nozzle passage inlet opening.

10. A distributor as defined in claim 8, in which:

(g) the piston first end portion has an angle of taper smaller than that of the piston second end portion.

11. A distributor as defined in claim 2, in which:

(f) the flow control means includes a passage extending forwardly of the chamber and having a diameter smaller than the chamber, the passage mounting a piston in sliding relation to the body and housing a resilient means exerting a pressure tending to move said piston toward said nozzle passage.

12. A distributor as defined in claim 11, in which:

(g) the piston is hollow to provide a housing for a spring providing the resilient means.

13. A distributor as defined in claim 1, in which:

(e) the nozzle passage is in a member which is removable and replaceable with a nozzle member having a passage of different size.

14. A distributor for delivering refrigerant from an expansion valve to a multi-circuit evaporator the distributor comprising:

(a) a body including inlet means outlet means and a chamber communicating between the inlet means and the outlet means;

(b) the inlet means including a nozzle passage;

(c) the outlet means including a plurality of discharge passages, (d) flow control means within the chamber, effective to vary the flow from the nozzle passage into the discharge passages, (e) the flow control means including a piston mounted in the body and having an end, and means urging the end toward the nozzle passage, (f) the piston end including a substantially conical end received by a nozzle passage to define a variable annulus, and (g) the piston including a rotatable member mounted to a piston shaft and tending to produce turbulence within the chamber during refrigerant flow.

15. A distributor as defined in claim 14, in which:

(h) the flow control means includes a rotatable member freely mounted to the piston and having vane means causing the rotatable member to rotate in response to pressure exerted on said vane means by said refrigerant and distribute the refrigerant evenly to the discharge passages.

16. A distributor as defined in claim 15, in which:

(i) the piston includes a collar slidably mounted to the body and providing a retainer for the rotatable member.

* * * * *